US007757867B2

(12) United States Patent
Hsieh

(10) Patent No.: US 7,757,867 B2
(45) Date of Patent: Jul. 20, 2010

(54) TOOL STORAGE RACK

(76) Inventor: Chih-Chien Hsieh, No. 10. Lane 715, Tung-Ping Road, Tai-Ping City, Taichung Hsien (TW)

( * ) Notice: Subject to any disclaimer, the term of this patent is extended or adjusted under 35 U.S.C. 154(b) by 404 days.

(21) Appl. No.: 11/965,488

(22) Filed: Dec. 27, 2007

(65) Prior Publication Data

US 2009/0166305 A1 Jul. 2, 2009

(51) Int. Cl.
*A47F 7/00* (2006.01)

(52) U.S. Cl. ..... 211/70.6

(58) Field of Classification Search ..... 211/70.6, 211/69, 60.1, 10, 11, 126.1; 220/23.88, 507, 220/676, 625, 476, 480, 4.21, 4.24, 23.4; 206/806, 378, 373, 349, 372
See application file for complete search history.

(56) References Cited

U.S. PATENT DOCUMENTS 4,381,836 A * 5/1983 Rivkin et al. ..... 206/387.11
4,634,004 A * 1/1987 Mortensen ..... 206/387.11
4,805,769 A * 2/1989 Soltis et al. ..... 206/308.2
5,209,147 A * 5/1993 Hawkins et al. ..... 82/161
6,079,559 A * 6/2000 Lee ..... 206/378
6,092,656 A * 7/2000 Ernst ..... 206/378
6,386,363 B1 * 5/2002 Huang ..... 206/378
6,698,600 B1 * 3/2004 Lee ..... 211/70.6
6,719,155 B1 * 4/2004 Chang ..... 211/70.6
2002/0070185 A1 * 6/2002 Chen ..... 211/70.6
2003/0024837 A1 * 2/2003 Chen ..... 206/378
2003/0213760 A1 * 11/2003 Lee ..... 211/70.6
2003/0234196 A1 * 12/2003 Hu ..... 206/372
2004/0094444 A1 * 5/2004 Chen ..... 206/376
2004/0238466 A1 * 12/2004 Shiao ..... 211/70.6
2006/0108300 A1 * 5/2006 Lin et al. ..... 211/70.6
2006/0207951 A1 * 9/2006 Wang ..... 211/70.6
2007/0023369 A1 * 2/2007 Lin ..... 211/70.6
2007/0205166 A1 * 9/2007 Meinhardt ..... 211/70.6
2008/0115401 A1 * 5/2008 Roemer et al. ..... 43/21.2
2008/0128370 A1 * 6/2008 Shih ..... 211/70.6
2008/0156754 A1 * 7/2008 Cheng ..... 211/70.6
2008/0251476 A1 * 10/2008 Shiao ..... 211/70.6
2009/0218302 A1 * 9/2009 Winnard ..... 211/70.6

* cited by examiner

*Primary Examiner*—Jennifer E. Novosad
(74) *Attorney, Agent, or Firm*—Bingham McCutchen LLP

(57) ABSTRACT

A tool storage rack is adapted for retaining a plurality of tool heads therein, and includes a positioning seat and a base seat coupled to the positioning seat. The positioning seat has a top wall, a surrounding wall extending downwardly from the top wall, and a plurality of spaced apart positioning holes formed in the top wall. The base seat has a base wall connected to the surrounding wall, and a plurality of positioning units formed on the base wall at positions corresponding respectively to the positioning holes. Each of the positioning units includes a pair of spaced apart positioning plates that extend upwardly from the base wall, and a pair of protrusions formed respectively at the positioning plates and adapted to abut against an internal wall surface of a tool head when the latter is sleeved on the positioning unit via a corresponding one of the positioning holes.

11 Claims, 6 Drawing Sheets

TOOL STORAGE RACK

BACKGROUND OF THE INVENTION

1. Field of the Invention

The invention relates to a storage rack, more particularly to a tool storage rack.

2. Description of the Related Art

Sockets are commonly used when tightening and loosening fasteners, such as bolts or nuts. A socket set includes a number of sockets with different diameters, such that a user can use the socket set with one handle for fitting different sizes of fasteners. After use, the socket set is generally stored in a tool storage rack. The conventional tool storage rack has a plurality of spaced apart socket holes, each of which is for retaining a respective one of the sockets. By virtue of the orderly storage, the user can easily and quickly find a selected one of the sockets.

However, since each of the sockets is placed in a respective one of the socket holes in the conventional tool storage rack without being secured therein, the sockets may fall out from the socket holes when the conventional tool storage rack is subjected to shock. Moreover, the conventional tool storage rack has no space for storing the handle and other hand tools, thereby resulting in a relatively poor storage flexibility.

SUMMARY OF THE INVENTION

Therefore, the object of the present invention is to provide a tool storage rack that can store orderly and secure firmly sockets and hand tools therein.

Accordingly, a tool storage rack of the present invention is adapted for retaining a plurality of tool heads therein. Each of the tool heads has a socket wall that has an internal surface. The tool storage rack comprises a positioning seat, and a base seat coupled to the positioning seat. The positioning seat has a top wall with a top wall periphery, a surrounding wall extending downwardly from the top wall periphery, and a plurality of spaced apart positioning holes formed in the top wall and adapted for receiving respectively the tool heads therein. The base seat has a base wall with a base wall periphery connected to the surrounding wall and a top surface facing the positioning seat, and a plurality of positioning units that are formed on the top surface of the base wall at positions corresponding respectively to the positioning holes in the positioning seat. Each of the positioning units includes a pair of spaced apart positioning plates that extend upwardly from the top surface of the base wall, and a pair of protrusions formed respectively at the positioning plates and adapted to abut against the internal wall surface of one of the tool heads when the tool head is sleeved on the positioning unit via a corresponding one of the positioning holes.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
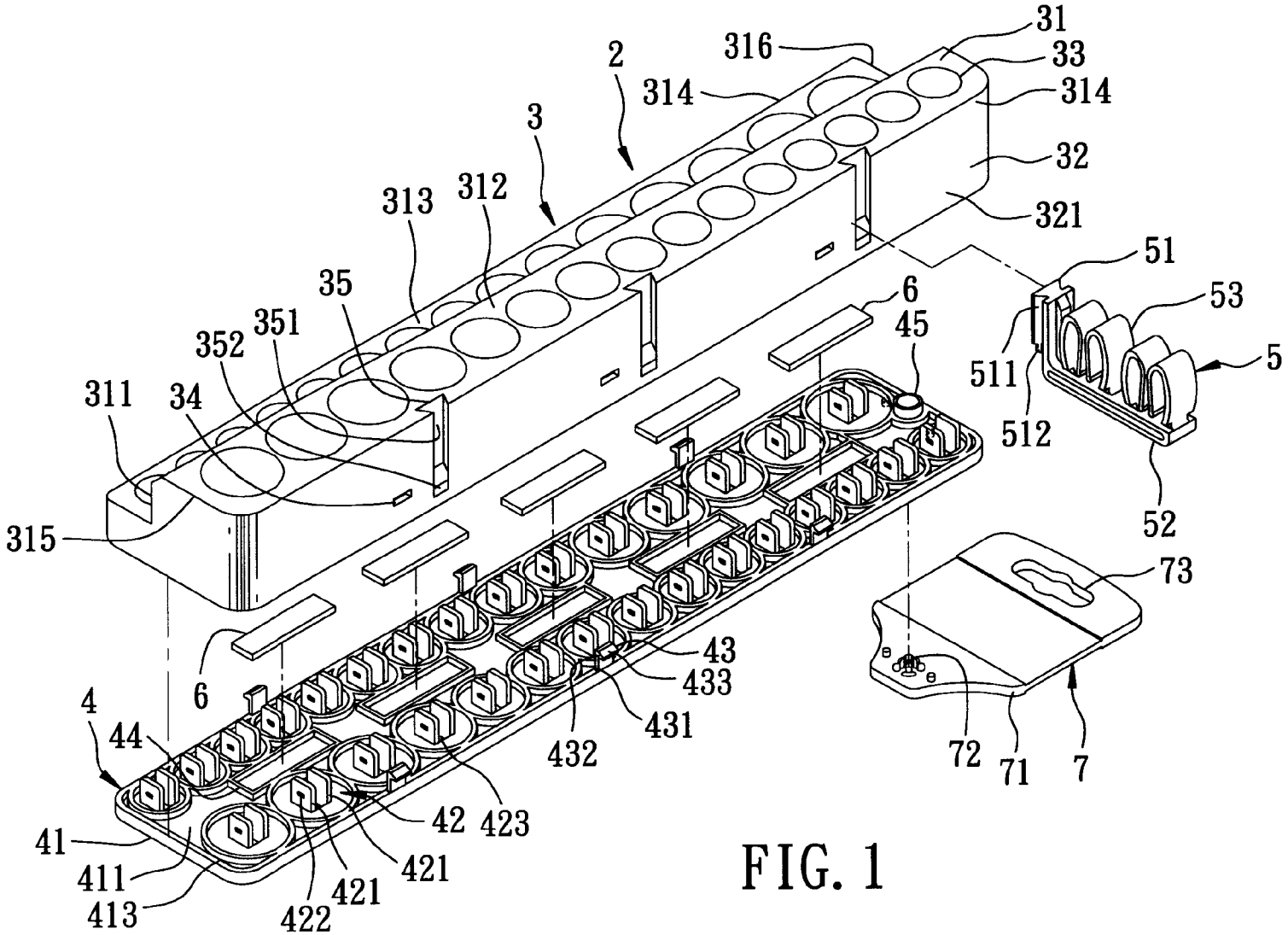
FIG. 1 is an exploded perspective view of a first preferred embodiment of a tool storage rack according to the invention.

Before the present invention is described in greater detail, it should be noted that like elements are denoted by the same reference numerals throughout the disclosure.

Figure 2:
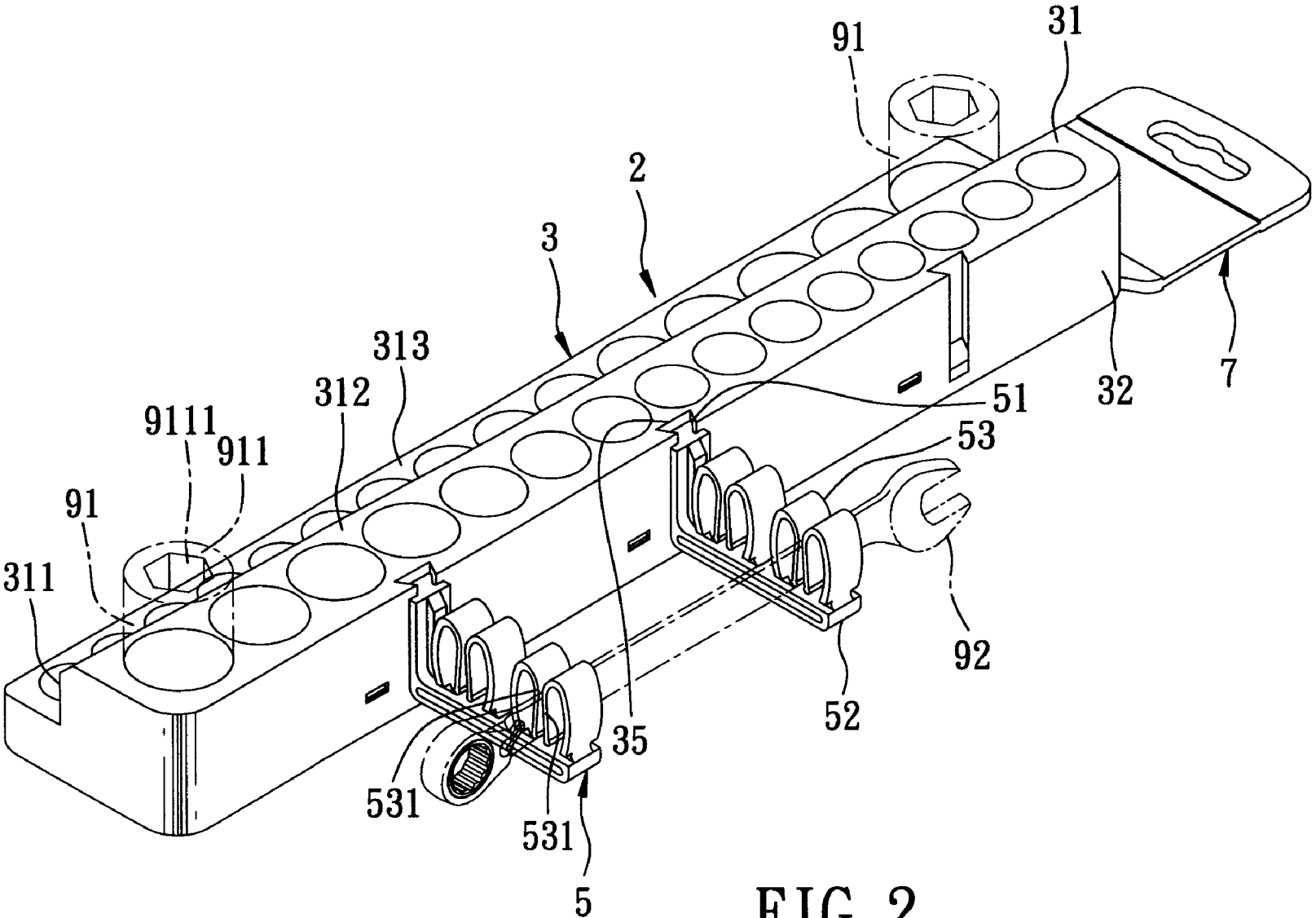
FIG. 2 is an assembled perspective view of the first preferred embodiment.
Figure 3:
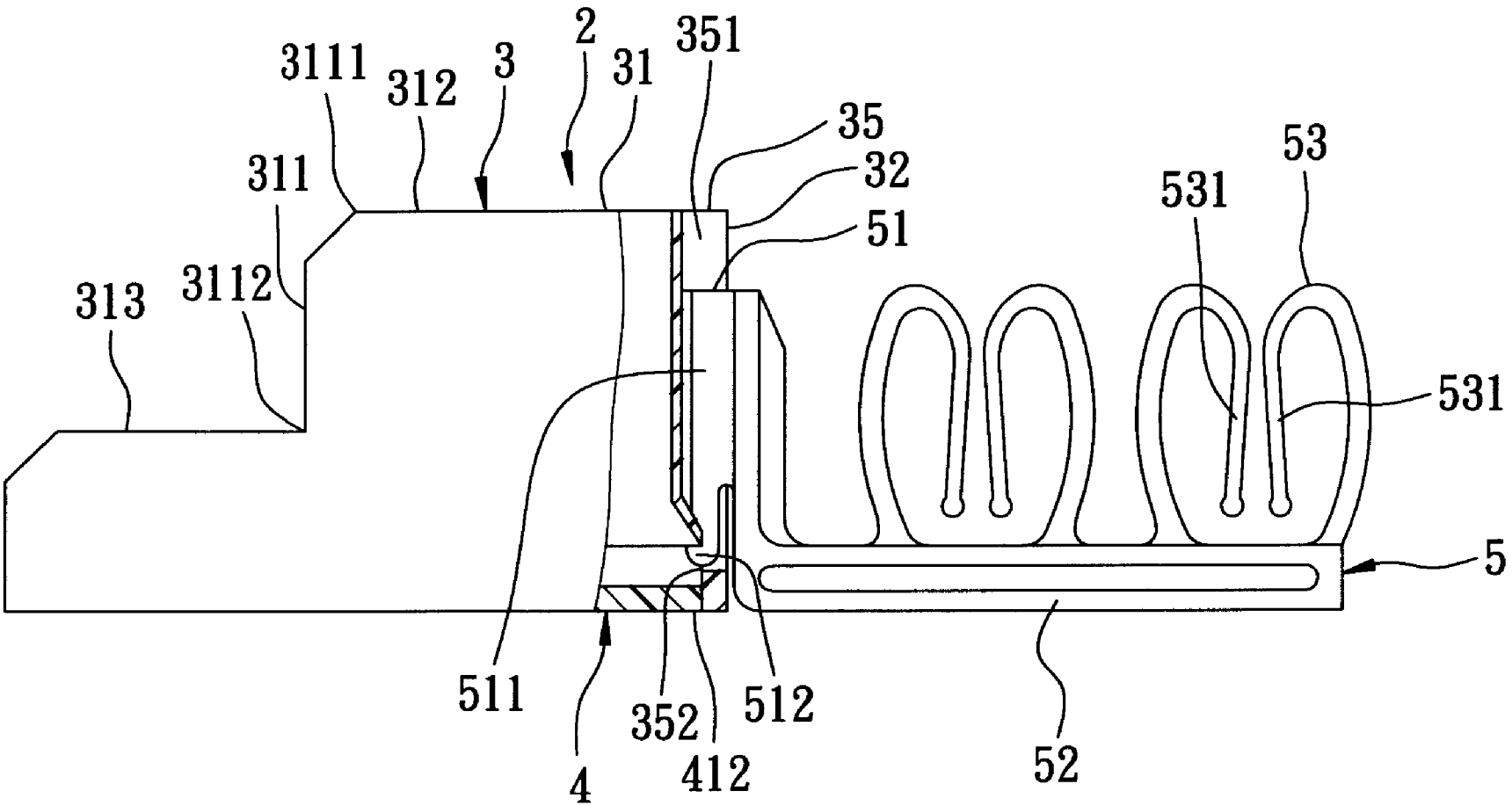
FIG. 3 is an assembled partly sectional view of the first preferred embodiment, illustrating a supporting seat engaging a positioning seat.

As shown in FIGS. 1 to 3, the first preferred embodiment of a tool storage rack 2 according to the present invention is adapted for retaining a plurality of tool heads therein, such as sockets 91 in this embodiment. Each of the sockets 91 has a socket wall 911 with an internal wall surface 9111. The tool storage rack 2 comprises a positioning seat 3, a base seat 4, and a plurality of spaced apart supporting seats 5.

The positioning seat 3 has a top wall 31 with a top wall periphery 314, a surrounding wall 32 extending downwardly from the top wall periphery 314 and having an outer surface 321, a plurality of spaced apart positioning holes 33 formed in the top wall 31 and adapted for receiving respectively the sockets 91, a plurality of spaced apart engaging holes 34 formed at one end of the surrounding wall 32 distal from the top wall 31, and a plurality of spaced apart seat engaging portions 35. With further reference to FIG. 3, the top wall 31 has a connecting portion 311 extending substantially vertically and having opposite first and second horizontal edges 3111, 3112, a first step portion 312 extending horizontally from the first horizontal edge 3111, a second step portion 313 extending horizontally from the second horizontal edge 3112 in a direction opposite to that in which the first step portion 311 extends, and opposite first and second ends 315, 316. The positioning holes 33 are formed in the first and second step portions 311, 312 and are spaced apart from one another. Since the positioning holes 33 are formed in the different step portions 312, 313 so as to have different depths, sockets 91 having different lengths can be retained suitably and respectively in the different positioning holes 33. In this embodiment, the positioning holes 33 in the first step portion 312 are formed in one line from the first end 315 to the second end 316 and have diameters that decrease from the first end 315 to the second end 316, and the width of the first step portion 312 decreases from the first end 315 to the second end 316. In addition, the positioning holes 33 in the second step portion 313 are formed in one line from the first end 315 to the second end 316 and have diameters that increase from the first end 315 to the second end 316, and the width of the second step portion 313 increases from the first end 315 to the second end 316. Therefore, the size of the tool storage rack 2 of the invention can be effectively reduced, i.e., the storage capacity of a unit volume of the tool storage rack 2 of the invention can be effectively increased.

The base seat 4 is coupled to the positioning seat 3, and has a base wall 41 that has a base wall periphery 413 connected to the surrounding wall 32 of the positioning seat 3, a top surface 411 facing the positioning seat 3, and a bottom surface 412 disposed opposite to the top surface 411, and a plurality of positioning units 42 that are formed on the top surface 411 of the base wall 41 at positions corresponding respectively to the positioning holes 33 in the positioning seat 3. Each of the positioning units 42 has a pair of spaced apart positioning plates 421 extending upwardly from the top surface 411 of the base wall 41, and a pair of protrusions 422 formed respectively at the positioning plates 421 and adapted to abut against the internal wall surface 9111 of one of the sockets 91 when the socket 91 is sleeved on the positioning unit 42 via a corresponding one of the positioning holes 33. Each of the positioning units 42 further has a through hole 423 formed through the base wall 41 between the positioning plates 421, such that the material consumption of the base seat 4 can be reduced. The base seat 4 further has a plurality of spaced apart engaging components 43 for coupling the base seat 4 to the positioning seat 3. Preferably, each of the engaging components 43 has a resilient main body 431 formed at the base wall periphery 413 at positions corresponding to the engaging holes 34, and a hook member 432 provided on the main body 431 and formed with an inclined guide surface 433 such that the hook member 432 is snap fitted in a corresponding one of the engaging holes 34 through guidance of the inclined guide surface 433.

The base seat 4 further has a plurality of spaced apart retaining grooves 44 in the top surface 411 of the base wall 41 adjacent to the positioning units 42. The tool storage rack 2 of the invention further comprises a plurality of auxiliary positioning components 6 retained respectively in the retaining grooves 44. In this embodiment, the auxiliary positioning components 6 are in the form of magnets.

Figure 5:
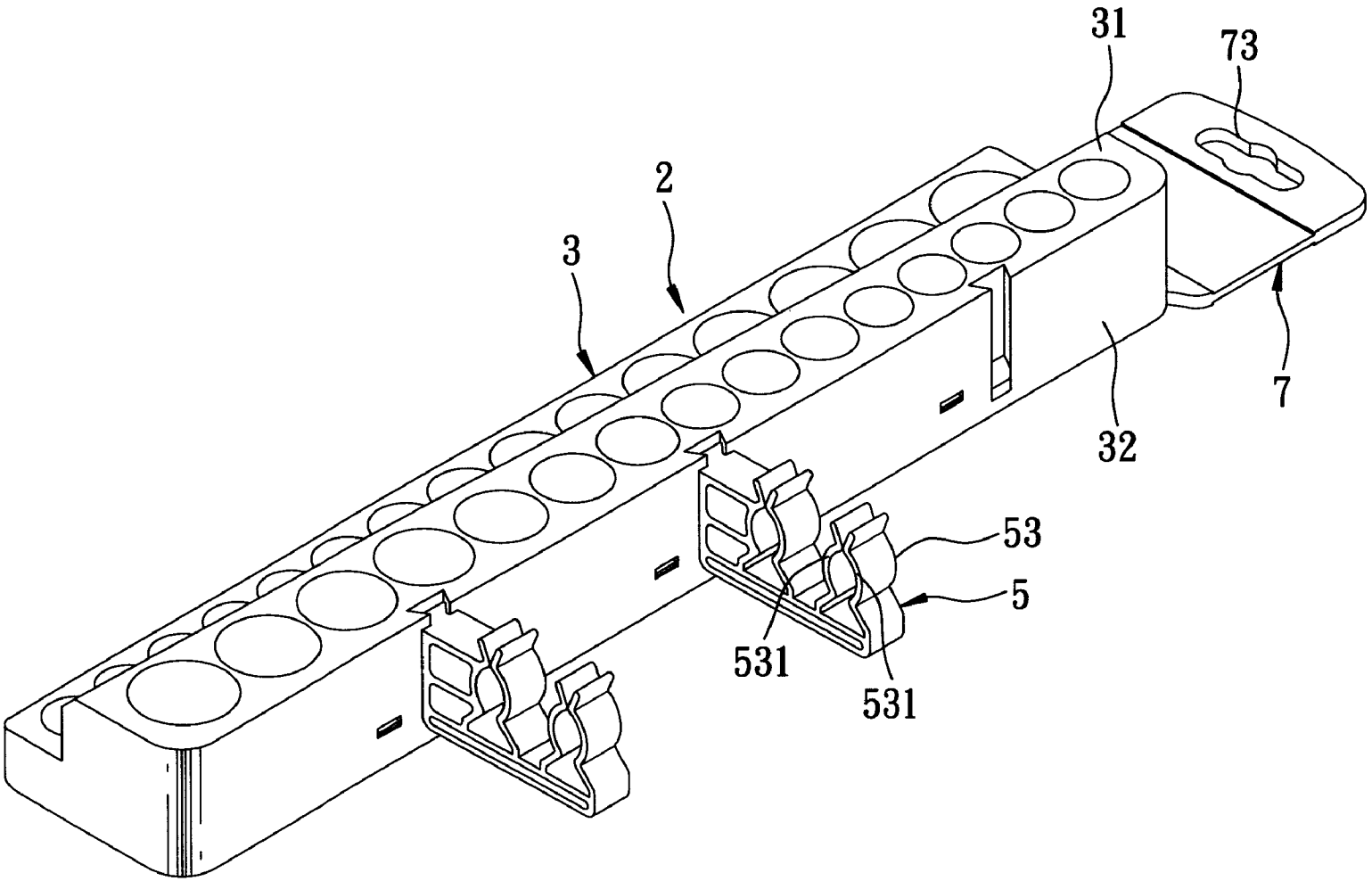
FIG. 5 is an assembled perspective view of the first preferred embodiment with modified supporting seats.

In this embodiment, each of the supporting seats 5 has a seat engaging section 51 that engages detachably a respective one of the seat engaging portions 35 in the positioning seat 3, a base section 52 that is connected to the seat engaging section 51, and a pair of spaced apart positioning sections 53 that are disposed on the base section 52. Each of the positioning sections 53 includes a pair of resilient positioning components 531. Each of the positioning sections 53 on one of the supporting seats 5 is aligned with one of the positioning sections 53 on other ones of the supporting seats 5 relative to the surrounding wall 32 of the positioning seat 3 such that the resilient positioning components 531 of aligned ones of the positioning sections 53 are adapted for retaining a portion of a hand tool 92. It should be noted that the number of positioning sections 53 of the positioning seat 5 may be one or more than two in other embodiments so as to comply with actual requirements. Moreover, the actual form of each of the resilient positioning components 531 may be varied as long as the distance between the resilient positioning components 531 is smaller than the diameter of the hand tool 92, and the insertion and removal of the hand tool 92 between the resilient positioning components 531 are controlled by the resiliency of the resilient positioning components 531. A possible modified form of the resilient positioning components 531 is illustrated in FIG. 5.

As shown in FIGS. 1 and 3, each of the seat engaging portions 35 of the positioning seat 3 has a dovetail groove 351 that is formed in the outer surface 321 of the surrounding wall 32 of the positioning seat 3 and that extends downwardly from the top wall periphery 314 of the top wall 31 of the positioning seat 3, and a positioning hole 352 that is formed through the surrounding wall 32 under the dovetail groove 351. The seat engaging section 51 of each of the supporting seats 5 includes a dovetail block 511 that engages detachably the dovetail groove 351 of the respective one of the seat engaging portions 35, and a positioning block 512 that is disposed under the dovetail block 511 and that engages the positioning hole 352 of the respective one of the seat engaging portions 35.

Figure 4:
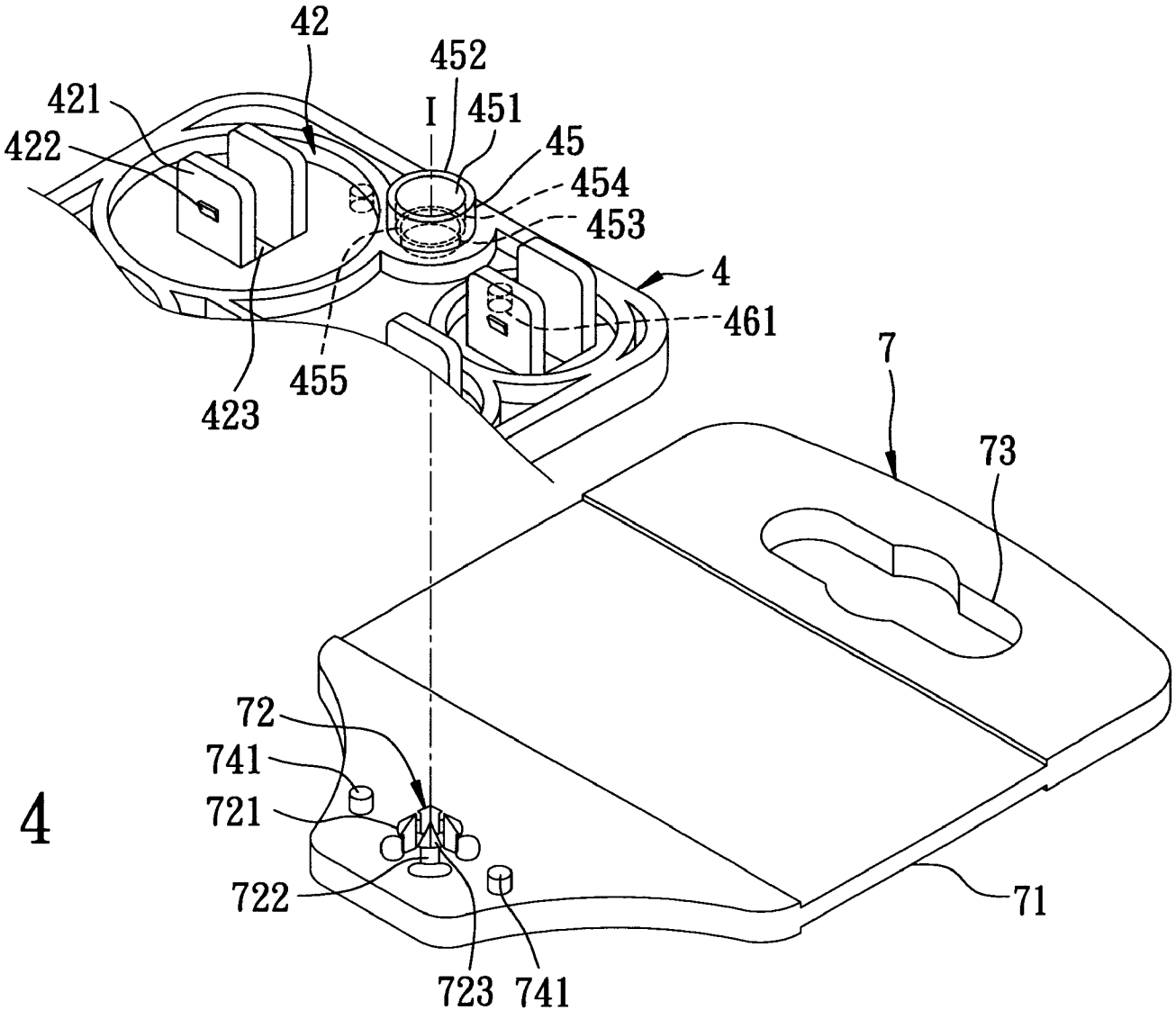
FIG. 4 is a fragmentary exploded perspective view of the first preferred embodiment, illustrating a hanging plate and a coupling unit.

Preferably, the tool storage rack 2 of the invention further comprises a hanging plate 7 (see FIGS. 1 and 4) that has a plate body 71, a coupling portion 72 that is formed at one end of the plate body 71 for coupling the hanging plate 7 to the base wall 41 of the base seat 4, and a hanging hole 73 that is formed at an opposite end of the plate body 7. The base seat 4 further has a coupling unit 45 formed at the base wall 41 and engaging the coupling portion 72, such that the tool storage rack 2 of the invention can be hung when desired. The coupling unit 45 has a coupling hole 451 formed through the base wall 41 of the base seat 4, and an annular wall 452 defining the coupling hole 451 and surrounding an axis (I). The coupling hole 451 has a small diameter portion 453 formed adjacent to the bottom surface 412 (see FIG. 3) of the base wall 41, a large diameter portion 454 formed adjacent to the top surface 411, and a shoulder portion 455 formed between the small diameter portion 453 and the large diameter portion 454. The coupling portion 72 includes a plurality of spaced apart resilient coupling claws 721 that are arranged to correspond to the form of the coupling hole 451. Each of the coupling claws 721 has a claw body 722 connected to the plate body 71, and a claw head 723 formed at one end of the claw body 722 opposite to the plate body 71. The coupling portion 72 engages the coupling unit 45 of the base seat 4 in a snap-fitting manner. In particular, by virtue of the resilient deformation of the coupling claws 721 relative to the axis (I), the coupling claws 721 can extend into the coupling hole 451 from the small diameter portion 453 to the large diameter portion 454 such that the coupling heads 723 abut against the shoulder portion 455, thereby coupling the hanging plate 7 to the base seat 4.

The base seat 4 further has a pair of recesses 461 formed in the bottom surface 412 of the base wall 41 and spaced apart from the coupling unit 45. The hanging plate 7 further has a pair of connecting blocks 741 that are disposed on the plate body 71 and that extend respectively into the recesses 461 when the hanging plate 7 is coupled to the base seat 4, thereby increasing the coupling strength therebetween.

Therefore, the sockets 91 can be retained respectively in the positioning holes 33 in the positioning seat 3, and can be secured respectively by the positioning units 42 of the base seat 4. On the other hand, the hand tools 92 can be retained firmly by the positioning sections 53 of the supporting seats 5. Besides, since the sockets 91 are generally made of metal, the auxiliary positioning components 6 provide magnetic attraction forces to assist in positioning of the sockets 91. Moreover, the tool storage rack 2 of the invention is assembled from parts with simple configurations instead of being formed from one piece having a complicated configuration, thereby resulting in a simple molding process during the production of the tool storage rack 2 of the invention. Furthermore, the positioning seat 3 is designed in a hollow form, thereby saving the manufacturing cost of the tool storage rack 2 of the invention.

Figure 6:
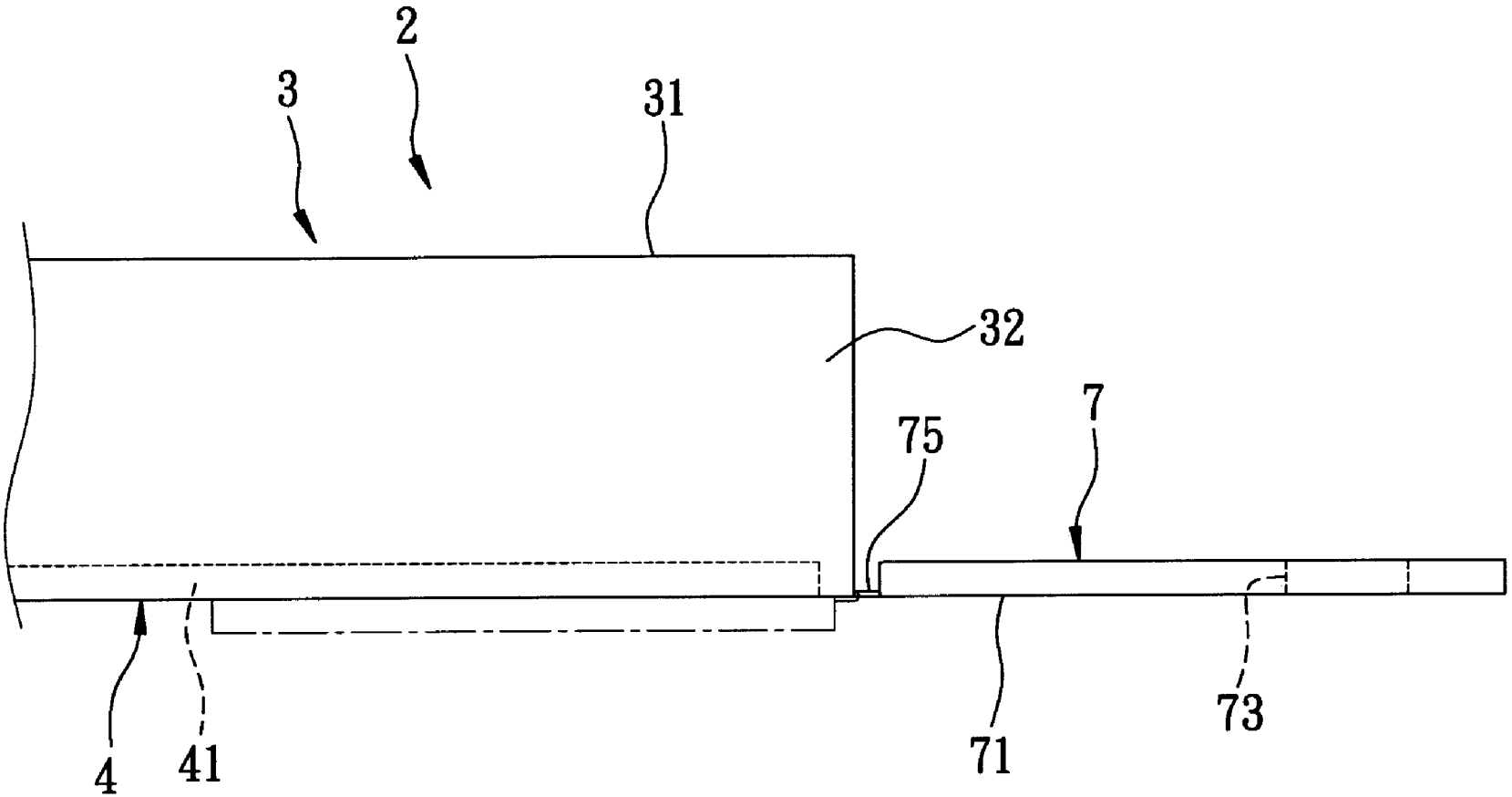
FIG. 6 is a fragmentary schematic side view of a second preferred embodiment of the tool storage rack according to the invention.

As shown in FIG. 6, the second preferred embodiment of the tool storage rack 2 according to the present invention has a structure similar to that of the first embodiment. The main difference between this embodiment and the previous preferred embodiment resides in the configuration of the hanging plate 7 as outlined in the following. The hanging plate 7 has a bendable portion 75 connected to the surrounding wall 32 of the positioning seat 3, a plate body 71 extending from the bendable portion 75, and a hanging hole 73 formed in the plate body 71. The hanging plate 7 is foldable via the bendable portion 75 between a folded position, where the plate body 71 contacts the base wall 41, such that the volume of the tool storage rack 2 can be reduced for packaging, and a hanging position, where the plate body 71 is unfolded and the tool storage rack 2 can be hung via the hanging hole 73. The second preferred embodiment also has the same advantages as those of the first preferred embodiment.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A tool storage rack adapted for retaining a plurality of tool heads therein, each of the tool heads having a socket wall that has an internal wall surface, said tool storage rack comprising:

a positioning seat having a top wall with a top wall periphery, a surrounding wall extending downwardly from said top wall periphery, and a plurality of spaced apart positioning holes formed in said top wall and adapted for receiving respectively the tool heads therein; and a base seat coupled to said positioning seat, and having a base wall with a base wall periphery connected to said surrounding wall and a top surface facing said positioning seat, and a plurality of positioning units that are formed on said top surface of said base wall at positions corresponding respectively to said positioning holes in said positioning seat, each of said positioning units including a pair of spaced apart positioning plates extending upwardly from said top surface of said base wall, and a pair of protrusions formed respectively at said positioning plates and adapted to abut against the internal wall surface of one of the tool heads when the tool head is sleeved on said positioning unit via a corresponding one of said positioning holes.

2. The tool storage rack as claimed in claim 1, wherein said top wall of said positioning seat has a connecting portion extending substantially vertically and having opposite first and second horizontal edges, a first step portion extending horizontally from said first horizontal edge, and a second step portion extending horizontally from said second horizontal edge in a direction opposite to that in which said first step portion extends, said positioning holes being formed in said first and second step portions and being spaced apart from one another.

3. The tool storage rack as claimed in claim 1, wherein:

said positioning seat further has a plurality of spaced apart engaging holes formed at one end of said surrounding wall distal from said top wall; and said base seat further has a plurality of spaced apart engaging components, each of which has a resilient main body formed at said base wall periphery of said base wall at positions corresponding to said engaging holes in said positioning seat, and a hook member provided on said main body and formed with an inclined guide surface such that said hook member is snap fitted in a corresponding one of said engaging holes through guidance of said inclined guide surface for coupling said base seat to said positioning seat.

4. The tool storage rack as claimed in claim 1, wherein:

said base seat further has a plurality of spaced apart retaining grooves formed in said top surface of said base wall adjacent to said positioning units; and said tool storage rack further comprises a plurality of auxiliary positioning components in the form of magnets retained respectively in said retaining grooves.

5. The tool storage rack as claimed in claim 1, wherein:

said positioning seat further has a plurality of spaced apart seat engaging portions; and said tool storage rack further comprises a plurality of spaced apart supporting seats, each having a seat engaging section that engages detachably a respective one of said seat engaging portions, a base section that is connected to said seat engaging section, and a positioning section that is disposed on said base section, said positioning sections of said supporting seats being aligned with one another relative to said surrounding wall of said positioning seat.

6. The tool storage rack as claimed in claim 5, wherein:

said surrounding wall of said positioning seat has an outer surface;

each of said seat engaging portions has a dovetail groove that is formed in said outer surface and that extends downwardly from said top wall periphery of said top wall of said positioning seat, and a positioning hole that is formed through said surrounding wall under said dovetail groove; and said seat engaging section of each of said supporting seats includes a dovetail block that engages detachably said dovetail groove of the respective one of said seat engaging portions, and a positioning block that is disposed under said dovetail block and that engages said positioning hole of the respective one of said seat engaging portions.

7. The tool storage rack as claimed in claim 5, wherein said positioning section of each of said supporting seats includes a pair of resilient positioning components adapted for retaining a portion of a hand tool.

8. The tool storage rack as claimed in claim 1, further comprising a hanging plate that has a plate body, a coupling portion that is formed at one end of said plate body for coupling said hanging plate to said base wall of said base seat, and a hanging hole that is formed at an opposite end of said plate body, said base seat further having a coupling unit formed at said base wall and engaging said coupling portion of said hanging plate.

9. The tool storage rack as claimed in claim 8, wherein said coupling portion of said hanging plate engages said coupling unit of said base seat in a snap-fitting manner.

10. The tool storage rack as claimed in claim 9, wherein:

said base wall of said base seat further has a bottom surface opposite to said top surface;

said base seat further has a pair of recesses formed in said bottom surface of said base wall and spaced apart from said coupling unit; and said hanging plate further has a pair of connecting blocks that are disposed on said plate body and that extend respectively into said recesses.

11. The tool storage rack as claimed in claim 1, further comprising a hanging plate that has a bendable portion connected to said surrounding wall of said positioning seat, a plate body extending from said bendable portion, and a hanging hole formed in said plate body.

* * * * *